US008925852B2

(12) United States Patent
Nakada

(10) Patent No.: US 8,925,852 B2
(45) Date of Patent: Jan. 6, 2015

(54) MEDIUM SUPPLYING APPARATUS AND IMAGE FORMING APPARATUS

(71) Applicant: Kikuya Nakada, Saitama (JP)

(72) Inventor: Kikuya Nakada, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 184 days.

(21) Appl. No.: 13/664,909

(22) Filed: Oct. 31, 2012

(65) Prior Publication Data

US 2013/0126659 A1 May 23, 2013

(30) Foreign Application Priority Data

Nov. 17, 2011 (JP) ..... 2011-251951

(51) Int. Cl.

| | |
|---|---|
| ***B65H 23/06*** | (2006.01) |
| ***B65H 59/02*** | (2006.01) |
| ***B65H 77/00*** | (2006.01) |
| ***B65H 23/182*** | (2006.01) |

(52) U.S. Cl.

CPC ..... *B65H 23/182* (2013.01); *B65H 2301/4493* (2013.01); *B65H 2403/722* (2013.01); *B65H 2403/732* (2013.01); *B65H 2403/942* (2013.01); *B65H 2404/143* (2013.01); *B65H 2404/147* (2013.01); *B65H 2801/06* (2013.01); *B65H 2801/15* (2013.01)

USPC ..... 242/420.4

(58) Field of Classification Search

USPC ..... 242/419.2, 419.9, 420.4, 421.2, 421.4, 242/418, 418.1

See application file for complete search history.

(56) References Cited

U.S. PATENT DOCUMENTS

| | | | | |
|---|---|---|---|---|
| 5,076,563 | A * | 12/1991 | Namba et al. | 271/10.09 |
| 8,777,220 | B2 * | 7/2014 | Oshiro et al. | 271/258.01 |
| 2009/0121423 | A1 * | 5/2009 | Nakamura et al. | 271/275 |
| 2010/0327515 | A1 | 12/2010 | Nakada et al. | |
| 2012/0032021 | A1 | 2/2012 | Morinaga et al. | |

FOREIGN PATENT DOCUMENTS

| | | |
|---|---|---|
| JP | 9-164737 | 6/1997 |
| JP | 2003-276264 | 9/2003 |
| JP | 2009-256061 | 11/2009 |

* cited by examiner

*Primary Examiner* — Emmanuel M Marcelo
*Assistant Examiner* — Angela Caligiuri
(74) *Attorney, Agent, or Firm* — IPUSA, PLLC

(57) ABSTRACT

A medium supplying apparatus for applying a back tension opposite to a transferring direction of a rolled medium being transferred by a transfer unit, to the rolled medium, includes a driving unit including a drive gear to be rotated in a forward direction and a reverse direction; a rotation transmitting mechanism that includes a one-way clutch and a torque limiter and transmits a rotational force between the driving unit and a medium rotation shaft that rotatably holds the rolled medium via the one-way clutch and the torque limiter; and a control unit that controls the driving unit to be one of states including being rotated in the forward direction, being rotated in the reverse direction and not being power supplied while the rolled medium is being transferred by the transfer unit to change the strength of the back tension.

11 Claims, 18 Drawing Sheets

FIG.15

| | | WIDTH | | |
|---|---|---|---|---|
| | | SMALL | MIDDLE | LARGE |
| | | STARTING DELAY TIME | STARTING DELAY TIME | STARTING DELAY TIME |
| REMAINING AMOUNT | SMALL | Ta1 | Ta2 | Ta3 |
| | MIDDLE | Ta2 | Ta3 | Ta4 |
| | LARGE | Ta3 | Ta4 | Ta5 |

FIG.16

| | | WIDTH | | | | | |
|---|---|---|---|---|---|---|---|
| | | SMALL | | MIDDLE | | LARGE | |
| | | STARTING DELAY TIME | TERMINATING DELAY TIME | STARTING DELAY TIME | TERMINATING DELAY TIME | STARTING DELAY TIME | TERMINATING DELAY TIME |
| REMAINING AMOUNT | SMALL | Ta55 | Tb11 | Ta44 | Tb22 | Ta33 | Tb33 |
| | MIDDLE | Ta44 | Tb22 | Ta33 | Tb33 | Ta22 | Tb44 |
| | LARGE | Ta33 | Tb33 | Ta22 | Tb44 | Ta11 | Tb55 |

MEDIUM SUPPLYING APPARATUS AND IMAGE FORMING APPARATUS

BACKGROUND OF THE INVENTION

1. Field of the Invention

The present invention relates to a medium supplying apparatus that supplies a medium and an image forming apparatus including the medium supplying apparatus.

2. Description of the Related Art

In an image forming apparatus such as an electrophotographic or ink-jet type copying machine, printer or the like, a paper housed inside the image forming apparatus is transferred, an image is formed on the paper by an image forming unit using toner, ink or the like, and then the paper is ejected outside the image forming apparatus.

In such an image forming apparatus, a rolled medium (hereinafter, referred to as a "rolled paper"), which is a rolled continuous sheet, is often used when printing the image on a large size paper such as A0 or A1. By using such a rolled paper, it is easy to handle the paper. Additionally, the size of the image forming apparatus with respect to the size of the paper can be made smaller.

When using the rolled paper, a transfer unit that holds the rolled paper with two pairs of transfer rollers is provided and the rolled paper is transferred from a housing of the rolled paper to the image forming unit by the transfer rollers of the transfer unit.

At this time, if the rolled paper is not attached to be in parallel with respect to the transfer rollers, a direction of a force transmitted by the transfer roller to the rolled paper and a moving direction of the rolled paper become different. At that time, the rolled paper may be transferred while being inclined with respect to the moving direction.

Such an inclination may also occur by looseness of the rolled paper which is caused when the transfer unit terminates the transferring of the rolled paper and the rolled paper is rotated by inertia, in addition to the above case which is caused when the rolled paper is attached. When the inclination is severe, wrinkling or twisting may occur on the rolled paper when the rolled paper is transferred such as in a forward direction or a reverse direction.

Thus, in order to suppress the generation of the wrinkling of the rolled paper caused by the inclination, a method in which a friction member is pushed toward an edge or a surface of the rolled paper, or a load is applied to an axial core of the rolled paper, which is being transferred in the forward direction, by a torque limiter or the like, is known.

By applying a back tension toward an opposite direction from the transfer direction of the rolled paper by applying the load using the friction member, the torque limiter or the like, the inclination of the rolled paper is corrected by a transferring force by the transfer rollers and the back tension to suppress the generation of the wrinkling.

The mechanism of correcting the inclination of the rolled paper by applying the back tension is explained with reference to FIG. 18. In FIG. 18, the lower side of a rolled paper R is tensioned between transfer rollers A and the rolled paper R, while the upper side of the rolled paper R is loosened. At this time, when the back tension is applied in a direction opposite to a transferring direction "T" of the rolled paper R, a transferring load "TL", which becomes lesser at the loosened side and greater at the tensioned side, is applied to the rolled paper R.

At this time, the transferring force by the transfer rollers A toward the rolled paper R becomes constant in the axial direction. Thus, an effective transferring force which is actually applied to the rolled paper R becomes a difference between the transferring force and the back tension and is expressed as an actual transferring force "ATF".

By applying the back tension, the actual transferring force "ATF" to transfer the rolled paper R can be greater at the loosened side and lesser at the tensioned side of the rolled paper R. Thus, the inclination can be corrected in a direction shown by an arrow "C".

However, as an appropriate strength for the back tension is different based on the size of the rolled paper, the remaining amount of the rolled paper or the like, the inclination of the rolled paper cannot be sufficiently corrected by applying a constant back tension to a rotation shaft of the rolled paper.

Thus, Patent Document 1, for example, discloses a technique in which a torque limiter is provided at a spool which rotatably supports the rolled paper to apply a rotation load when the rolled paper is transferred in a forward direction and providing a transferring force variable means, which is an electromagnetic clutch, that varies the transferring force of the rolled paper. In this technique, voltage to be applied to the electromagnetic clutch is continuously determined based on the detected widths of the rolled paper to control the back tension to enable a correction of an inclination in detail.

In Patent Document 2, a method in which a powder clutch is provided that engages a flange of a rolled paper to apply a back tension, an electric power supplied to the powder clutch is controlled based on an output of a remaining amount detection unit for the rolled paper, and the strength of the back tension applied to the rolled paper is varied, is disclosed.

However, by the techniques disclosed in Patent Document 1 or Patent Document 2, the electromagnetic clutch such as the powder clutch or the like is necessary so that the cost is increased and the structure and control for applying the back tension becomes complicated. Further, there may be a case when the inclination of the rolled paper caused by the looseness generated when the rolled paper is rotated by inertia after the transferring of the rolled paper by the transfer unit is terminated.

Patent Document

[Patent Document 1] Japanese Laid-open Patent Publication No. 2009-256061

[Patent Document 2] Japanese Laid-open Patent Publication No. H09-164737

SUMMARY OF THE INVENTION

The present invention is made in light of the above problems, and provides a medium supplying apparatus and an image forming apparatus including the medium supplying apparatus, capable of variably controlling the strength of a back tension in accordance with the size or the remaining amount of the rolled paper to suppress the generation of the looseness of the rolled paper with a simple structure.

According to an embodiment, there is provided a medium supplying apparatus for applying a back tension opposite to a transferring direction of a rolled medium being transferred by a transfer unit, to the rolled medium, including a driving unit including a drive gear to be rotated in a forward direction and a reverse direction; a rotation transmitting mechanism that includes a one-way clutch and a torque limiter and transmits a rotational force between the driving unit and a medium rotation shaft that rotatably holds the rolled medium via the one-way clutch and the torque limiter; and a control unit that controls the driving unit to be one of states including being rotated in the forward direction, being rotated in the reverse direction and not being power supplied while the rolled medium is being transferred by the transfer unit to change the strength of the back tension.

According to another embodiment, there is provided an image forming apparatus including the medium supplying apparatus and the transfer unit that transfers the rolled medium.

Note that also arbitrary combinations of the above-described constituents, and any exchanges of expressions in the present invention, made among method, device, system, recording medium, computer program and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

FIG. 15 is a view showing an example of a control table including a starting delay time and a terminating delay time for the back tension "middle to weak";

FIG. 16 is a view showing an example of a control table including a starting delay time and a terminating delay time for the back tension "middle to strong";

DETAILED DESCRIPTION OF THE PREFERRED EMBODIMENTS

Figure 1:
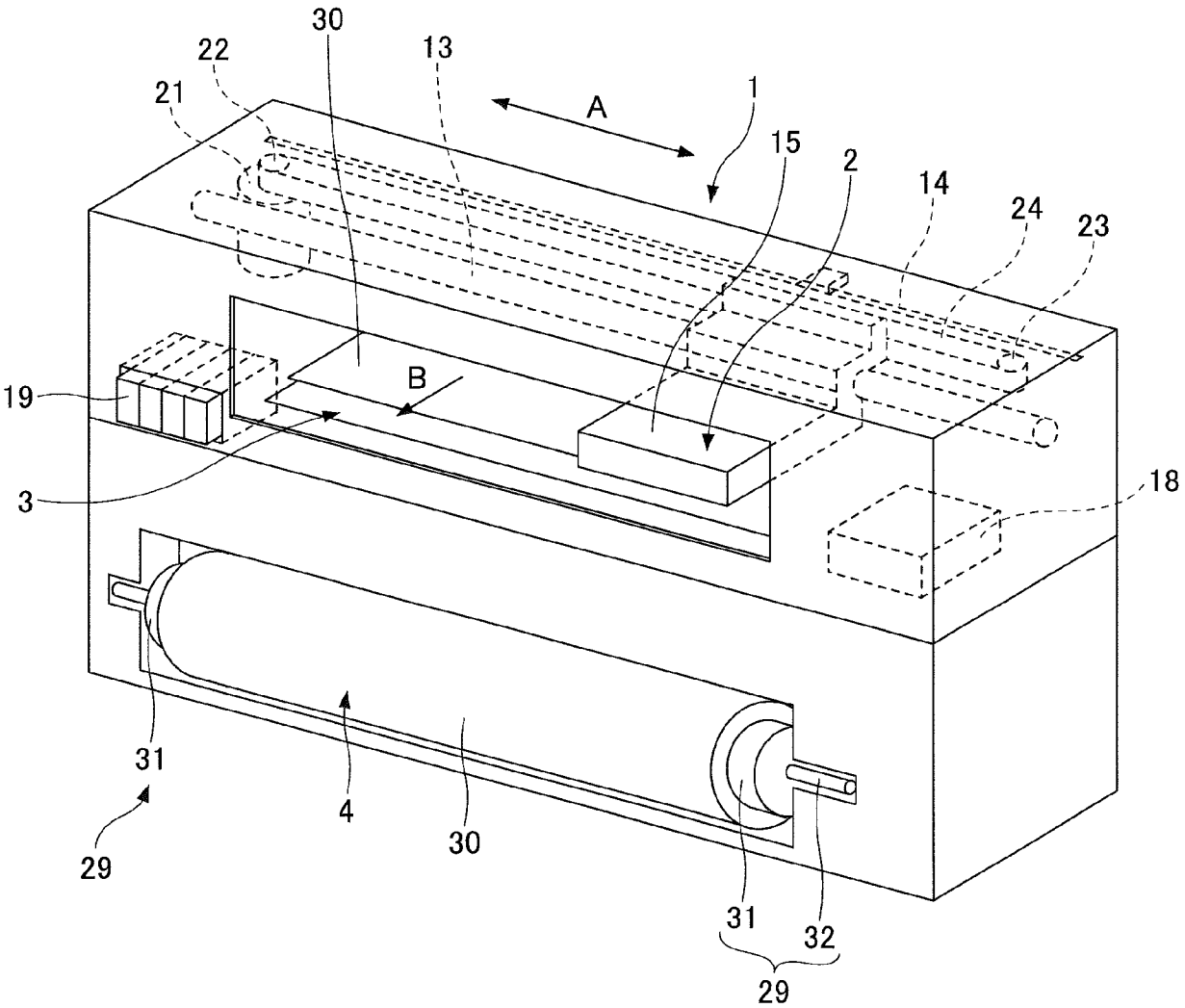
FIG. 1 is a perspective view showing an example of an image forming apparatus of an embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

(Structure of Image Forming Apparatus)

Figure 2:
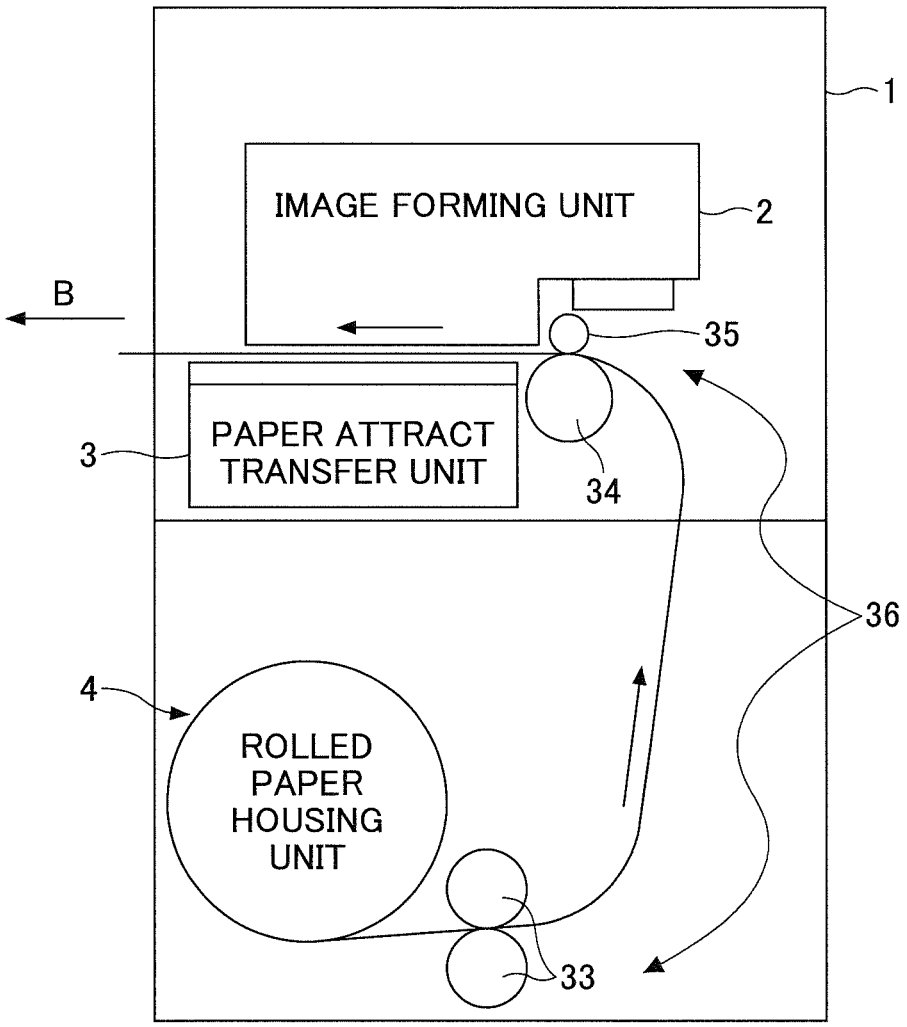
FIG. 2 is a cross sectional view schematically showing the image forming apparatus of the embodiment.

FIG. 1 is a perspective view showing an example of an image forming apparatus 1 of the embodiment. FIG. 2 is a cross sectional view schematically showing the image forming apparatus 1 of the embodiment.

Here, an example where the image forming apparatus 1 is an inkjet printer that forms an image by discharging ink in accordance with image data is explained. Alternatively, the image forming apparatus 1 may be an electrophotographic or ink-jet type copying machine, printer or the like that prints an image while transferring a paper.

The image forming apparatus 1 includes inside an image forming unit 2, a paper attract transfer unit 3, a rolled paper housing unit 4 that houses a rolled paper 30, a transfer unit 36, a maintenance and recovery mechanism 18, a main cartridge 19 and the like. As will be explained later, the image forming apparatus 1 further includes a medium supplying apparatus 90 (see FIG. 3 or the like).

The image forming unit 2 includes a guide rod 13, a guide rail 14, a carriage 15, and a main scanning mechanism. The guide rod 13 and the guide rail 14 are held by side plates, not shown in the drawings, positioned at both sides in a main scanning direction shown by an arrow A. The carriage 15 is movably supported by the guide rod 13 and the guide rail 14 in the main scanning direction.

The carriage 15 includes recording heads, not shown in the drawings, which discharge ink drops of black (K), yellow (Y), magenta (M), and cyan (C), respectively. Each of the recording heads includes a sub tank, not shown in the drawings, which is integrally formed with the respective recording head for supplying ink.

The main scanning mechanism moves and scans the carriage 15 in the main scanning direction. The main scanning mechanism includes a drive motor 21 which is positioned at a side of the main scanning direction, a drive pulley 22 which is rotated by the drive motor 21, a driven pulley 23 which is driven in accordance with the drive pulley 22, and a belt member 24 which is held by the drive pulley 22 and the driven pulley 23. The driven pulley 23 is applied with a tension by a tension spring, not shown in the drawings, toward the outside (a direction further from the drive pulley 22).

A part of the belt member 24 is held by a belt fixing portion provided at a back surface side of the carriage 15 and draws the carriage 15 in the main scanning direction. The position of the carriage 15 in the main scanning direction is detected by an encoder (carriage sensor), not shown in the drawings, provided at the carriage 15.

Within a recording area of the carriage 15, the rolled paper 30 is intermittently conveyed in a direction perpendicular to the main scanning direction of the carriage 15, a sub scanning direction shown by an arrow B (see FIG. 2), by the paper attract transfer unit 3.

The maintenance and recovery mechanism 18 performs a maintenance and recovery of the recording heads. The maintenance and recovery mechanism 18 is positioned at one end side within a main scanning area within which the carriage 15 moves.

The main cartridge 19 reserves ink of the above plural colors to be supplied to the sub tanks of the recording heads. The main cartridge 19 is detachably attached to the image forming apparatus 1. The main cartridge 19 is provided outside the main scanning area, or at another end side within the main scanning area.

The rolled paper (paper) 30 is wound around a cylindrical paper shaft, not shown in the drawings. The rolled paper housing unit 4 includes a pair of rolled paper holding members 29 each including a flange 31 and a spool shaft 32. The spool shaft 32 is attached to the flange 31 in each of the rolled paper holding members 29. The flanges 31 are attached to both ends of the paper shaft of the rolled paper 30. The rolled paper housing unit 4 is provided with a pair of spool shaft receiving portions, not shown in the drawings, for receiving the spool shafts 32, respectively. Thus, the rolled paper 30 is set in the rolled paper housing unit 4 via the rolled paper holding members 29.

It is possible to set rolled papers 30 having different sizes in the width direction (the direction shown by the arrow A in FIG. 1) in the rolled paper housing unit 4.

Referring to FIG. 2, the transfer unit 36 includes a pair of rollers 33, a resist roller 34 and a pressure roller 35. The rolled paper 30 is transferred in a forward direction by the pair of rollers 33, and the resist roller 34 and the pressure roller 35 from the rolled paper housing unit 4 through a back portion of the image forming apparatus 1.

The rollers 33 hold the rolled paper 30 and release the rolled paper 30 after the rolled paper 30 is transferred toward the resist roller 34 and the pressure roller 35. Then, the resist roller 34 and the pressure roller 35 hold the rolled paper 30 and transfer toward the paper attract transfer unit 3 (recording area).

The resist roller 34 and the pressure roller 35 are capable of transferring the rolled paper 30 in the forward direction from the rolled paper housing unit 4 and a backward direction toward the rolled paper housing unit 4 while being holding the rolled paper 30 therebetween. Here, when the rolled paper 30 is transferred within the recording area in the forward direction, the rolled paper 30 is applied with a predetermined tension between the resist roller 34 and the pressure roller 35, and the rolled paper housing unit 4.

Within the recording area, the resist roller 34 and the pressure roller 35 intermittently transfer the rolled paper 30 while the carriage 15 is moved in the main scanning direction with the recording heads in accordance with image data while discharging ink to form an image on the rolled paper 30.

A part of the rolled paper 30 on which the image is formed is cut for a predetermined length by a cutting unit, not shown in the drawings, to be ejected to an ejecting tray which is provided at a front side of the image forming apparatus 1.

(Back Tension Applying Mechanism of Medium Supplying Apparatus)

Figure 3:
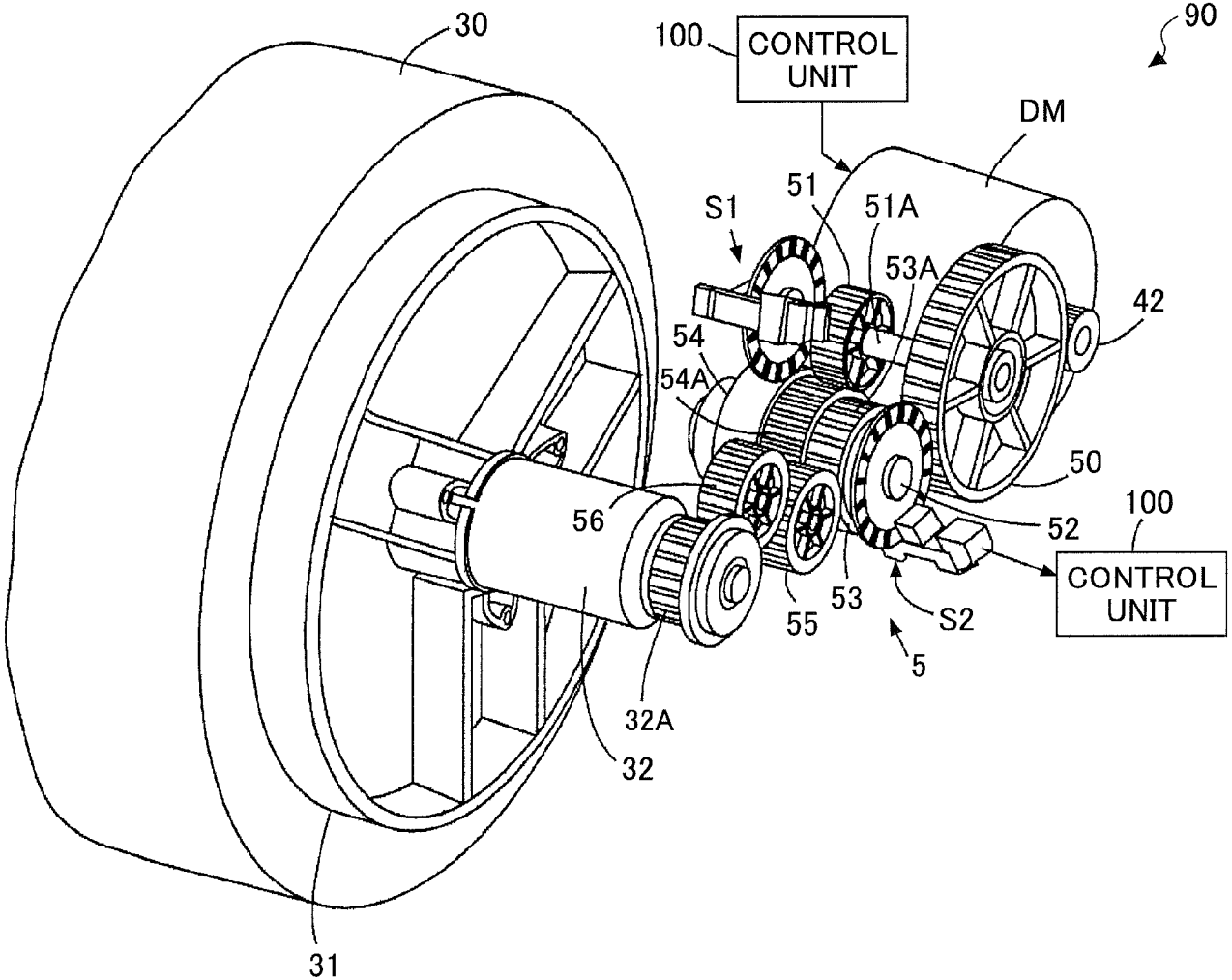
FIG. 3 is an enlarged perspective view showing an example of a medium supplying apparatus of the embodiment.
Figure 5:
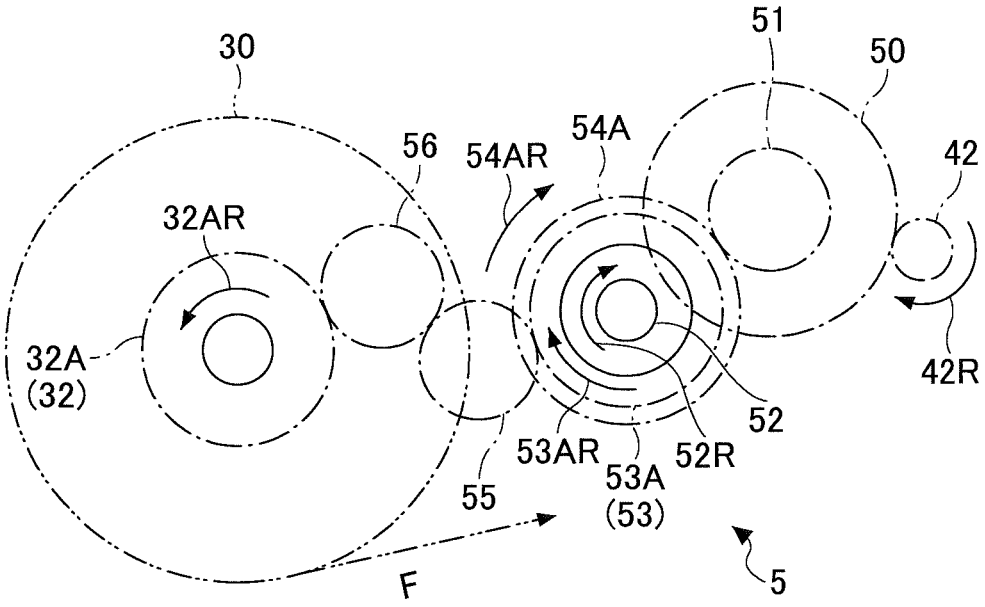
FIG. 5 is a side view for explaining the rotation of the rotation transmitting mechanism when the back tension is "middle"

FIG. 3 is an enlarged perspective view showing an example of a medium supplying apparatus 90 of the embodiment. The medium supplying apparatus 90 includes a rotation transmitting mechanism 5, a drive motor DM, a control unit 100. The medium supplying apparatus 90 applies a back tension to the rolled paper 30. FIG. 5 is a side view showing an example of the rotation transmitting mechanism 5. The structure of the medium supplying apparatus 90 is explained with reference to FIG. 3 and FIG. 5.

The rotation transmitting mechanism 5 is connected to at least one of the spool shafts 32 (medium rotation shaft) attached to the paper shaft of the rolled paper 30 and to the drive motor DM. The drive motor DM includes a drive gear 42 around which the drive motor DM is rotated.

The rotation transmitting mechanism 5 includes a driven gear 32A, idle gears 55 and 56, a one-way clutch 53 provided with a gear 53A, a rotation shaft 52 provided with a gear 54A and a torque limiter 54, a rotation shaft 51A provided with an idle gear 50 and a transmit gear 51, connected in this order from a rolled paper 30 side to a drive motor DM side.

The control unit 100 controls the rotation of the drive motor DM to apply a load to the spool shaft 32 for the rolled paper 30 to apply a back tension to the rolled paper 30 which is being transferred by the transfer unit 36 (see FIG. 2) of the image forming apparatus 1.

The driven gear 32A is provided to the spool shaft 32 so that the driven gear 32A is rotated in accordance with the rotation of the spool shaft 32. The driven gear 32A is connected to the gear 53A of the one-way clutch 53 via the idle gears 56 and 55.

When the rotation shaft 52 is rotated in one direction, the one-way clutch 53 is configured to lock the rotation of the rotation shaft 52 in that direction.

The torque limiter 54 is configured to shut a transmission of the torque between the rotation shaft 52 and the gear 54A when the torque generated between the rotation shaft 52 and the gear 54A exceeds a limitation of the torque limiter 54.

The gear 54A of the rotation shaft 52 engages the transmit gear 51 of the rotation shaft 51A. The idle gear 50 of the rotation shaft 51A engages the drive gear 42 of the drive motor DM.

The rotation shaft 52 is further provided with a remaining paper sensor S2, which is a remaining amount detection unit, for detecting the remaining amount of the rolled paper 30 by detecting the rotation amount.

The rotation shaft 51A is further provided with a rotation number sensor S1 for detecting the number of rotation of the drive motor DM.

The control unit 100 controls a power supply to the drive motor DM so that the state of the drive motor DM becomes either one of being rotated in a forward rotation, rotated in a reverse rotation and not rotated. With this structure, the medium supplying apparatus 90 of the embodiment is configured to apply a back tension of three steps including weak, middle and strong.

(Back Tension: Middle)

Figure 4:
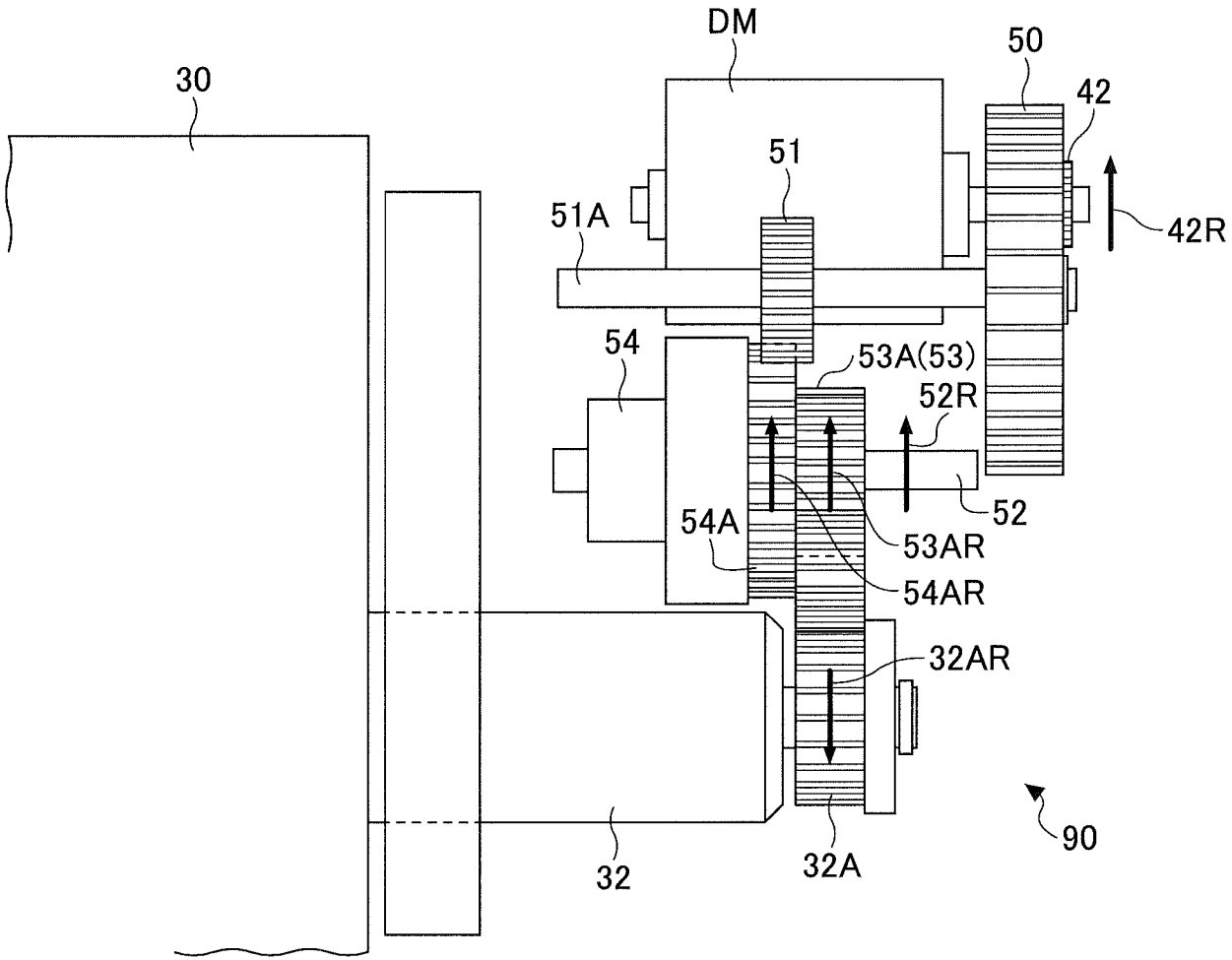
FIG. 4 is a plan view for explaining a rotation of a rotation transmitting mechanism when a back tension is "middle"

FIG. 4 and FIG. 5 are views for explaining the rotation of the rotation transmitting mechanism 5 when the back tension is "middle". Arrows shown in the drawings express the rotation directions of the gears, respectively.

When the rolled paper 30 is transferred in the forward direction "F", the spool shaft 32 is rotated in a direction shown by an arrow 32AR so that the gear 53A of the one-way clutch 53 is rotated in the direction shown by the arrow 53AR via the idle gears 56 and 55. The one-way clutch 53 is configured to transmit the driving force to the rotation shaft 52 when the one-way clutch 53 is rotated in the direction shown by the arrow 53AR. Thus, at this time, the rotation shaft 52 is rotated in the direction shown by the arrow 52R, which is the same as the direction shown by the arrow 53AR.

When the rotation shaft 52 is rotated in the direction shown by the arrow 52R, the gear 54A is rotated while the torque is limited by the torque limiter 54 to rotate the drive gear 42 of the drive motor DM in a direction shown by an arrow 42R via the transmit gear 51 and the like.

When the drive motor DM is controlled to not be power supplied (not driven) while the rolled paper 30 is being transferred, a load is applied to the spool shaft 32 for the rolled paper 30 for having the components of the rotation transmitting mechanism 5 and the drive gear 42 of the drive motor DM rotate. Thus, this load becomes a back tension to the rolled paper 30.

Here, in this embodiment, in order to have the drive gear 42 rotate when the drive motor DM is not being power supplied, the drive motor DM is set so that a drag torque of the drive motor DM becomes less than or equal to the limitation of the torque limiter 54. With this structure, the drive gear 42 of the drive motor DM is rotated in accordance with the rotation of the gear 54A.

(Back Tension: Weak)

Figure 6:
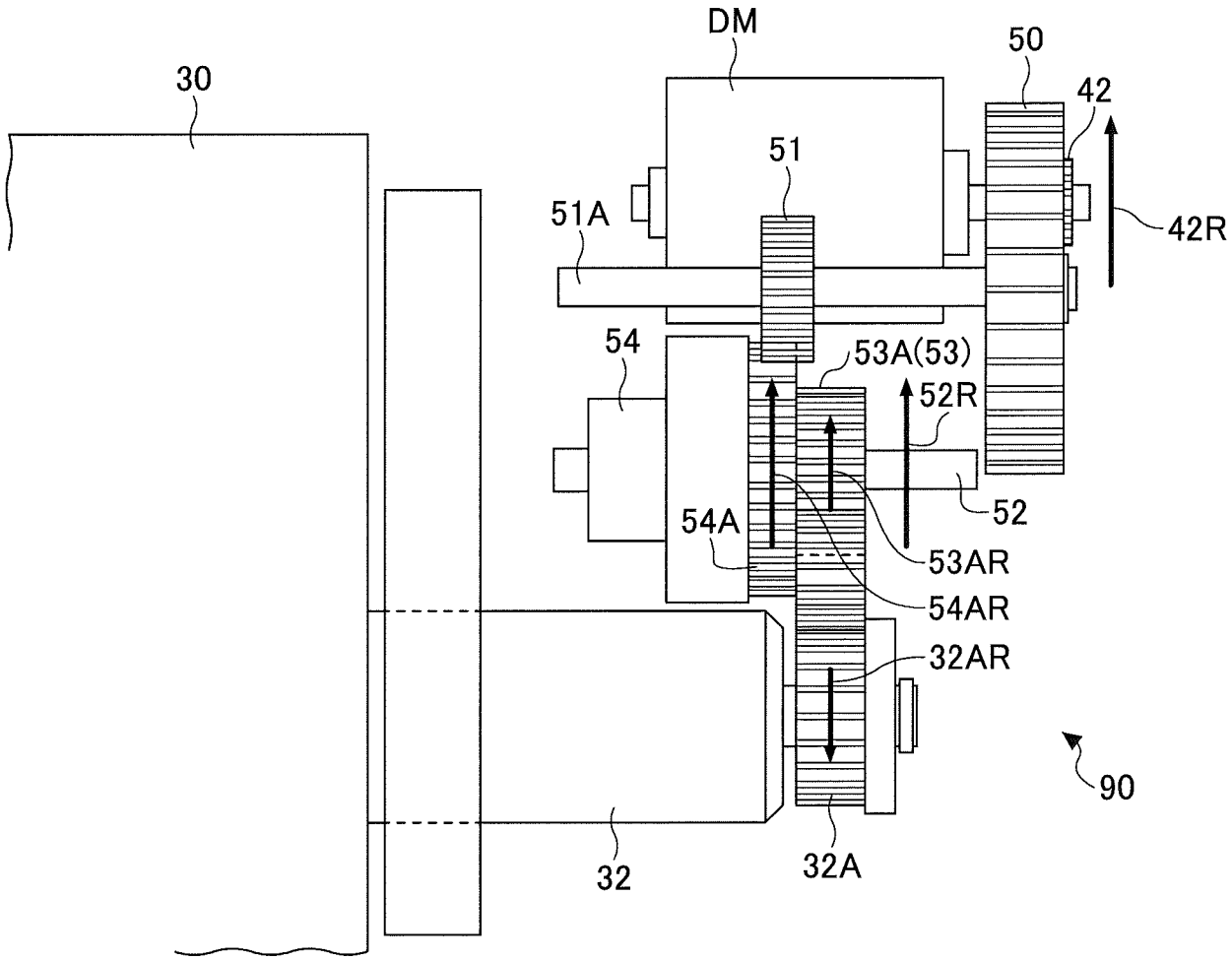
FIG. 6 is a plan view for explaining the rotation of the rotation transmitting mechanism when the back tension is "weak"
Figure 7:
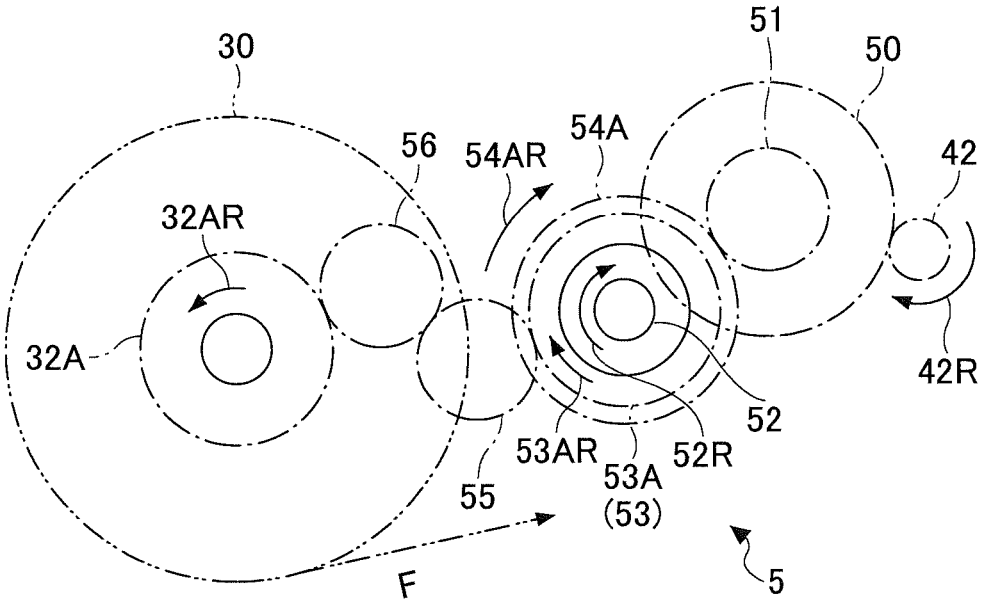
FIG. 7 is a side view for explaining the rotation of the rotation transmitting mechanism when the back tension is "weak"

FIG. 6 and FIG. 7 are views for explaining the rotation of the rotation transmitting mechanism 5 when the back tension is "weak". Arrows shown in the drawings express the rotation directions of the gears, respectively.

When the rolled paper 30 is transferred in the forward direction "F" and the spool shaft 32 is rotated, the gear 53A of the one-way clutch 53 is rotated in the direction shown by the arrow 53AR via the idle gears 56 and 55. As described above, the one-way clutch 53 is configured to transmit the driving force to the rotation shaft 52 when the one-way clutch 53 is rotated in the direction shown by the arrow 53AR. Thus, at this time, the rotation shaft 52 is rotated in the direction shown by the arrow 52R.

Here, the rotation shaft 52 is rotated in the direction shown by the arrow 52R by rotating the drive motor DM in the direction shown by the arrow 42R (hereinafter, referred to as a "forward direction") via the idle gear 50, the transmit gear 51 and the gear 54A.

Thus, in this case, by driving the drive motor DM to rotate in the forward direction to have the gear 54A rotate faster than the gear 53A of the one-way clutch 53, the rotation shaft 52 is rotated by the gear 54A, the torque limiter 54 and the like so that the gear 53A of the one-way clutch 53 slips with respect to the rotation shaft 52.

Even when the drive motor DM is driven in the forward direction at a speed greater than or equal to a predetermined speed, which is faster than the rotation speed of the gear 53A of the one-way clutch 53, a load is applied to the spool shaft 32 for the rolled paper 30. However, the load at this time is for having the gear 53A of the one-way clutch 53 rotate via the idle gears 56 and 55, which is less than the case when the drive motor DM is not power supplied. Thus, this load becomes a back tension "weak" to the rolled paper 30.

(Back Tension: Strong)

Figure 8:
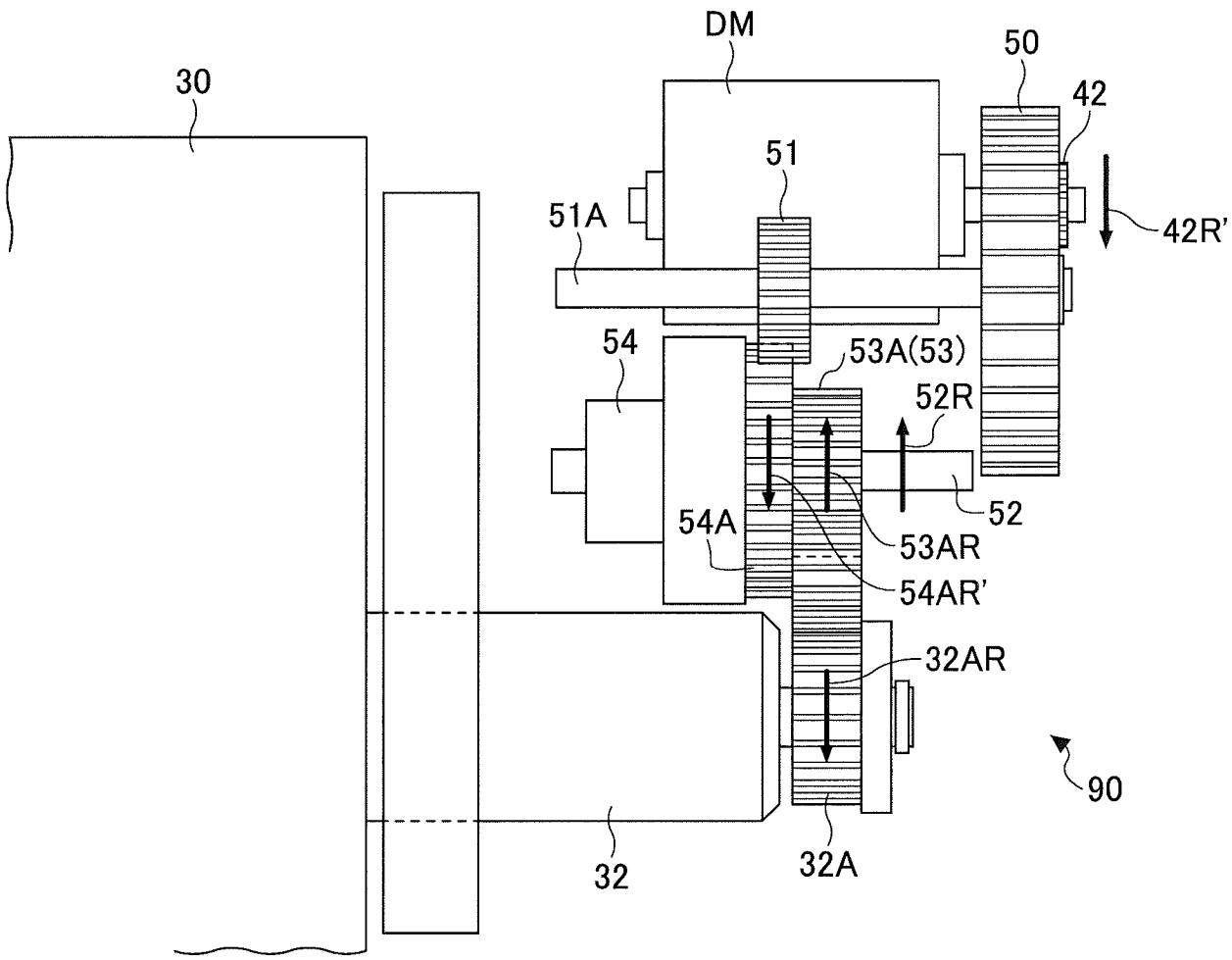
FIG. 8 is a plan view for explaining the rotation of the rotation transmitting mechanism when the back tension is "strong"
Figure 9:
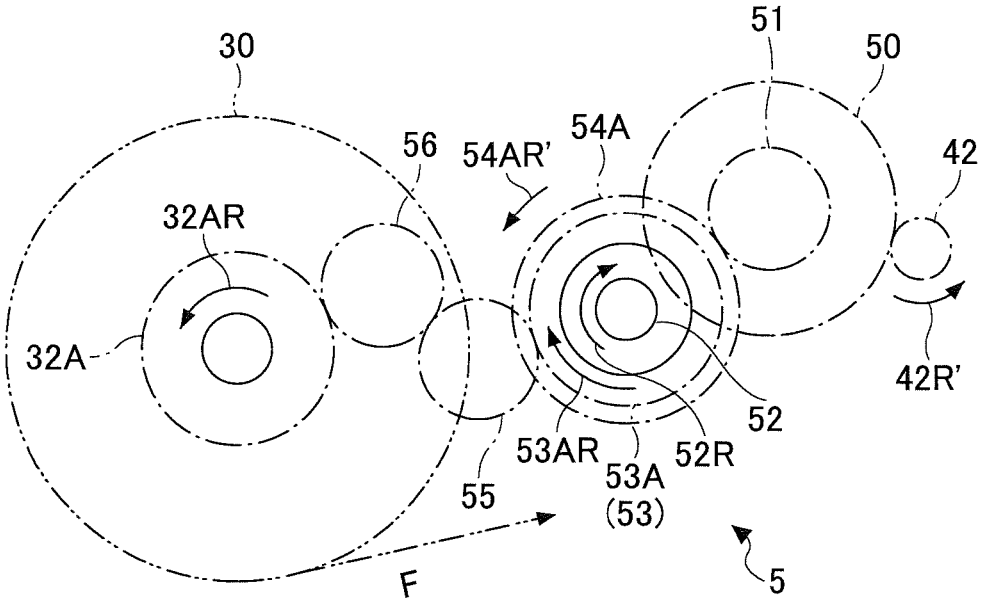
FIG. 9 is a side view for explaining the rotation of the rotation transmitting mechanism when the back tension is "strong"

FIG. 8 and FIG. 9 are views for explaining the rotation of the rotation transmitting mechanism 5 when the back tension is "strong". Arrows shown in the drawings express the rotation directions of the gears, respectively. Here, rotation directions which are different from those shown in FIG. 4 to FIG. 7 are shown with "'".

When the rolled paper 30 is transferred in the forward direction "F" and the spool shaft 32 is rotated in the direction shown by the arrow 32AR, the gear 53A of the one-way clutch 53 is rotated in the direction shown by the arrow 53AR via the idle gears 56 and 55. As described above, the one-way clutch 53 locks the rotation shaft 52 when being rotated in the direction shown by the arrow 53AR and the rotational force is transmitted to the rotation shaft 52 to rotate the rotation shaft 52 in the direction shown by the arrow 52R.

Here, by rotating the drive motor DM in a direction shown by an arrow 42R' (hereinafter, referred to as a "reverse direction"), the gear 54A is rotated in a direction shown by an arrow 54AR' via the idle gear 50 and the like.

At this state, as the rotation directions of the rotation shaft 52 and the gear 54A become opposite from each other so that a larger torque which exceeds the limitation of the torque limiter 54 is generated to shut a transmission of the torque. Thus, the rotation shaft 52 is rotated while slipping in the torque limiter 54.

Therefore, when the drive motor DM is rotated in the reverse direction, a strong load is applied to the spool shaft 32 for the rolled paper 30 against the rotation of the spool shaft 32 caused by a resistance force applied to the rotation shaft 52 when slipping in the torque limiter 54. Thus, this load becomes a back tension "strong" to the rolled paper 30.

As described above, according to the medium supplying apparatus 90 of the embodiment, the back tension applied to the rolled paper 30 can be controlled to become one of three steps including "middle", "weak", and "strong" by controlling the driving state of the drive motor DM to not be power supplied (not driven), rotated in the forward direction, and rotated in the reverse direction.

(Rewinding Rolled Paper)

Further, by rotating the drive motor DM in the reverse direction after the transferring of the rolled paper 30 is terminated, the spool shaft 32 is rotated so that the rolled paper 30 can be rewound.

Figure 10:
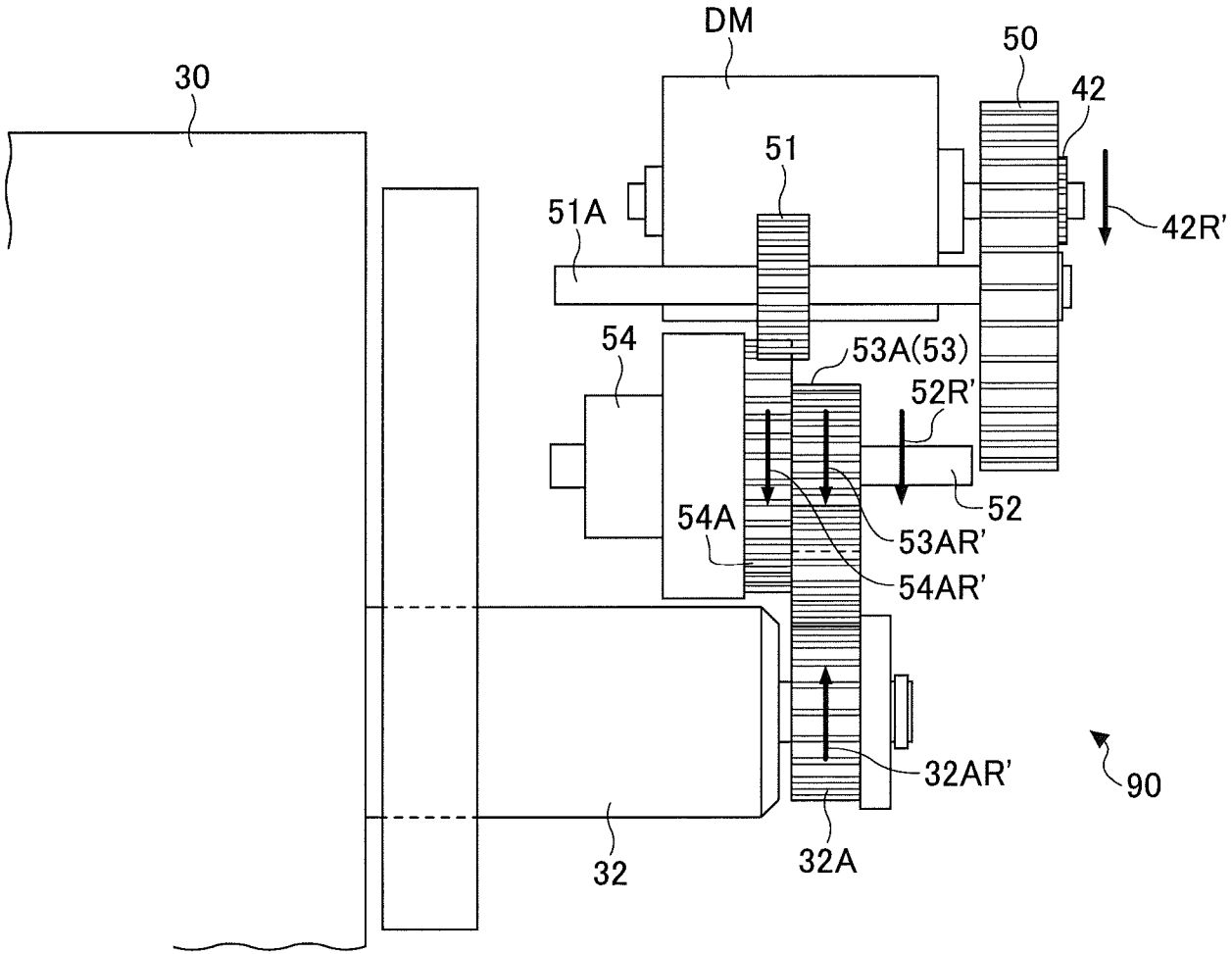
FIG. 10 is a plan view for explaining the rotation of the rotation transmitting mechanism when a rolled paper is rewound.
Figure 11:
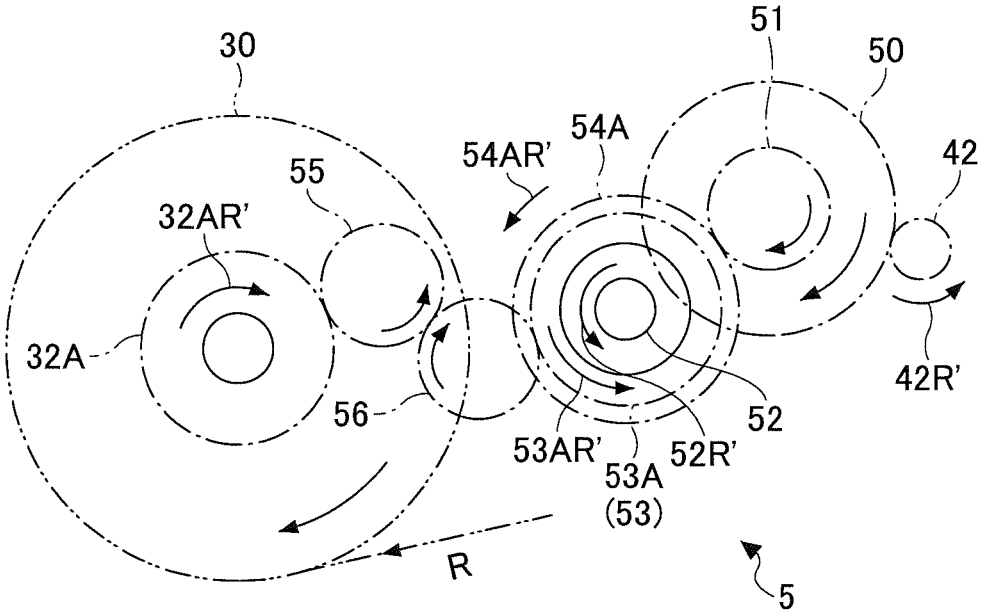
FIG. 11 is a side view for explaining the rotation of the rotation transmitting mechanism when a rolled paper is rewound.

FIG. 10 and FIG. 11 are views for explaining the rotation of the rotation transmitting mechanism 5 when the rolled paper 30 is rewound. Arrows shown in the drawings express the rotation directions of the gears, respectively. Here, rotation directions which are different from those shown in FIG. 4 to FIG. 7 are shown with "'".

Even when the transferring of the rolled paper 30 is terminated, the spool shaft 32 continues to rotate for a certain extent by inertia in the state where the rolled paper 30 is being transferred. Thus, looseness may occur in the rolled paper 30. Therefore, in this embodiment, when the transferring of the rolled paper 30 by the transfer unit 36 is terminated, the drive motor DM is rotated in the reverse direction shown by the arrow 42R'.

When the drive motor DM is rotated in the reverse direction, the gear 54A is rotated in the direction shown by the arrow 54AR' via the idle gear 50 and the transmit gear 51 so that the rotation shaft 52 is rotated in a direction shown by an arrow 52R' within a limitation range of the torque limiter 54.

When the rotation shaft 52 is rotated, the one-way clutch 53 locks the rotation shaft 52 so that the gear 53A is rotated in a direction shown by an arrow 53AR'. Then, the driving force is transmitted to the gear 32A via the idle gears 55 and 56 so that the gear 32A is rotated in a direction shown by an arrow 32AR'. With this operation, the spool shaft 32 is rotated in a direction to rewind the rolled paper 30 in a reverse direction "R".

Thus, by rotating the drive motor DM in the reverse direction after the transferring of the rolled paper 30 is terminated by the control unit 100, the spool shaft 32 is rotated to rewind the rolled paper 30 so that the looseness generated in the rolled paper 30 can be removed.

(Control of Back Tension)

Figure 12:
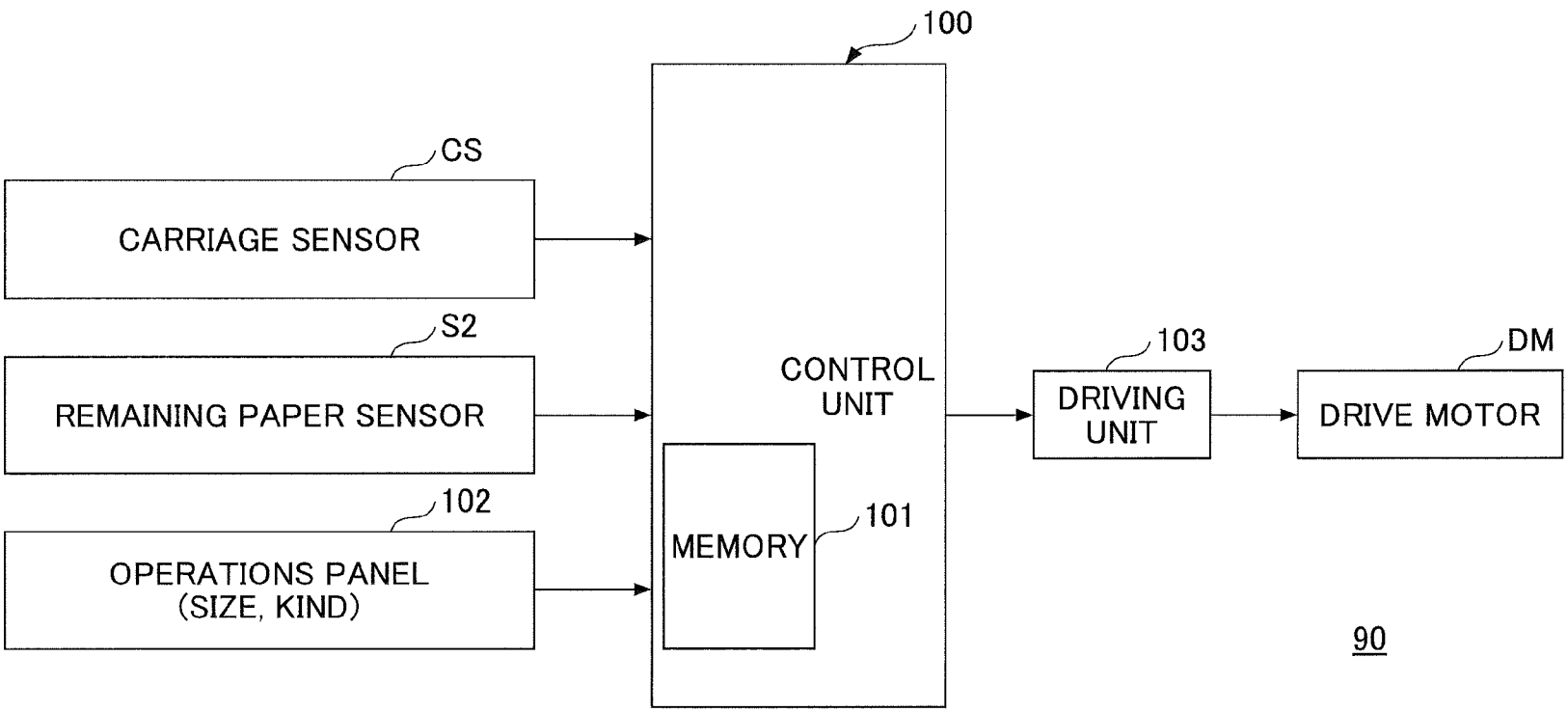
FIG. 12 is a block diagram showing an example of a control unit of a medium supplying apparatus of the embodiment.

FIG. 12 is a block diagram showing an example of a control unit 100 of the medium supplying apparatus 90 of the embodiment.

The control unit 100 includes a memory 101. The control unit 100 controls the rotation of the drive motor DM based on a control table for the drive motor DM stored in the memory 101.

The control unit 100 is connected to a carriage sensor CS (the encoder), the remaining paper sensor S2, and an operations panel 102 capable of inputting the size and a kind of the rolled paper at an input side of the control unit 100. The control unit 100 is further connected to a driving unit 103 of the drive motor DM at an output side.

The carriage sensor CS detects a position of the carriage 15 in the main scanning direction. The remaining paper sensor S2 detects the remaining amount of the rolled paper 30 based on the rotation amount of the rotation shaft 52 of the rotation transmitting mechanism 5 as described above.

As described above, according to the medium supplying apparatus of the embodiment, the back tension of three steps including "weak", "middle", and "strong" can be applied to the rolled paper 30. Further, by the control unit 100, the back tension to be applied to the rolled paper 30 can be further controlled in detail by varying the strength of the back tension while transferring the rolled paper 30 in accordance with the width (size) of the rolled paper 30 or the remaining amount of the rolled paper 30.

Figure 13:
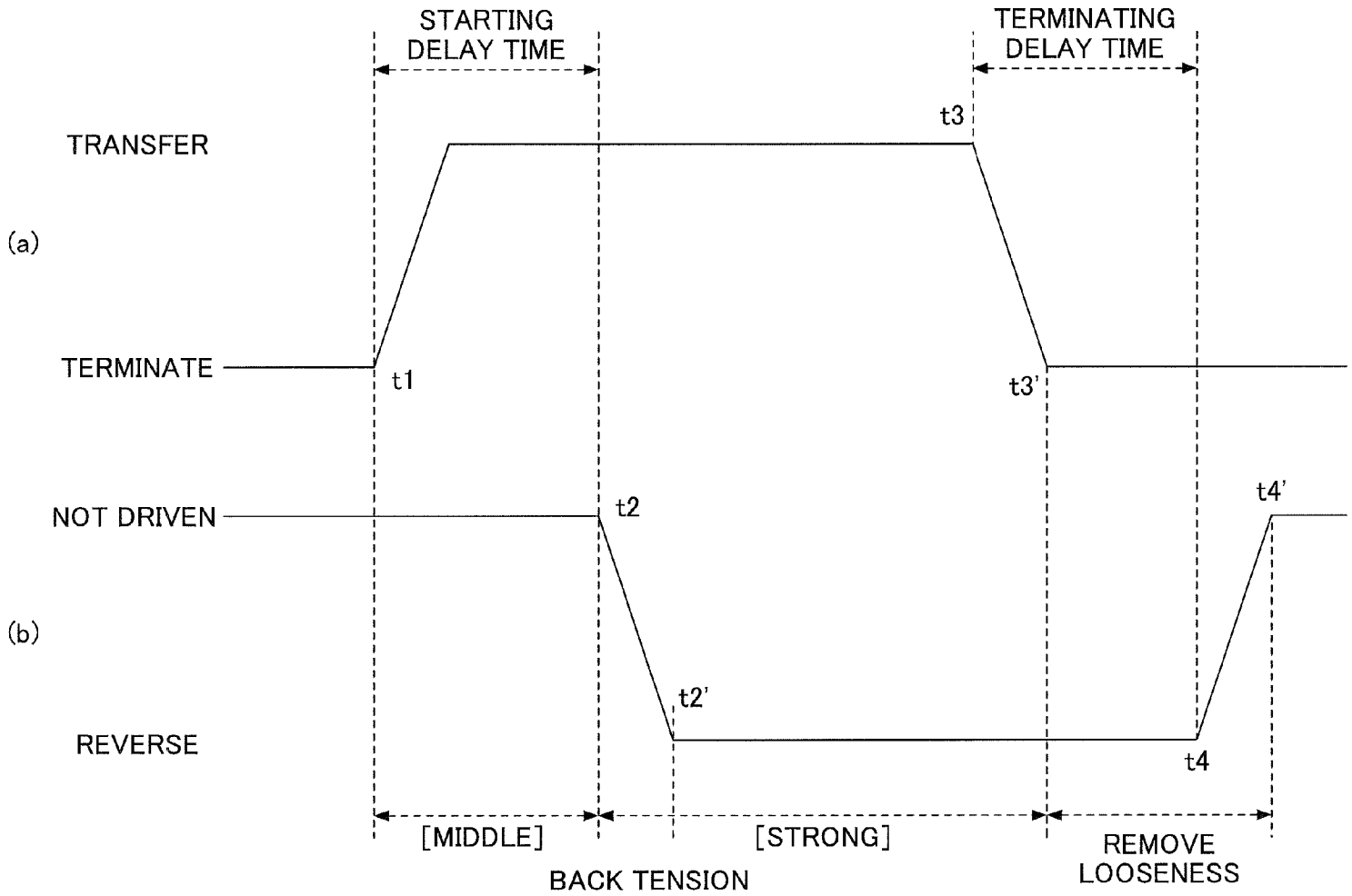
FIG. 13 is a view showing an example of a timing of controlling the drive motor DM by the control unit of the medium supplying apparatus of the embodiment.

FIG. 13 is a view showing an example of a timing of controlling the drive motor DM by the control unit 100 of the medium supplying apparatus 90 of the embodiment. In FIG. 13, (a) shows a driving timing of the resist roller 34 of the transfer unit 36 for the rolled paper 30, and (b) shows a control timing of the drive motor DM by the control unit 100.

For the example shown in FIG. 13, when the rolled paper 30 is not transferred, the drive motor DM is controlled to not be power supplied (not driven). Then, the rolled paper 30 is started to be transferred at time t1 while the drive motor DM is kept controlled to not be power supplied. At this time, as described above, the back tension to be applied to the rolled paper 30 becomes "middle".

Then, the drive motor DM is controlled to be rotated in the reverse direction at time t2 when a previously set predetermined period has passed after the rolled paper 30 is started to be transferred at time t1. When the drive motor DM is controlled to be rotated in the reverse direction (at time t2'), as described above, the back tension to be applied to the rolled paper 30 becomes "strong".

The drive motor DM is continuously rotated in the reverse direction while the rolled paper 30 is being transferred. Then, the transferring of the rolled paper 30 is terminated at time t3.

Subsequently, the drive motor DM is controlled to not be power supplied (not driven) again at time t4 when a previously set predetermined period has passed after the transferring of the rolled paper 30 is terminated at the time t3.

Here, the period between the time t1 and the time t2 is referred to as a "starting delay time".

By providing the starting delay time between a start of the transferring of the rolled paper 30 (at the time t1) and a start of the rotation of the drive motor DM in the reverse direction (at the time t2), the back tension to the rolled paper 30 can be shifted from "middle" to "strong" while the rolled paper 30 is being transferred. Thus, by appropriately determining the starting delay time, the back tension applied to the rolled paper 30 which is being transferred can be set to a desired strength between "middle" and "strong".

The period between the time t3 and the time t4 is referred to as a "terminating delay time".

By providing the terminating delay time between the termination of the transferring of the rolled paper 30 (at the time t3) and a termination of the rotation of the drive motor DM (at the time t4), which is being rotated in the reverse direction, the looseness of the rolled paper 30 can be prevented from generating by rewinding the rolled paper 30, which tends to be rotated in the forward direction by inertia, by the drive motor DM rotated in the reverse direction.

As described above, by having the control unit 100 to control the drive motor DM with providing the starting delay time and the terminating delay time, it is possible to remove the looseness of the rolled paper as well as to apply the back tension with a desired strength between "middle" to "strong" to the rolled paper 30.

Figure 14:
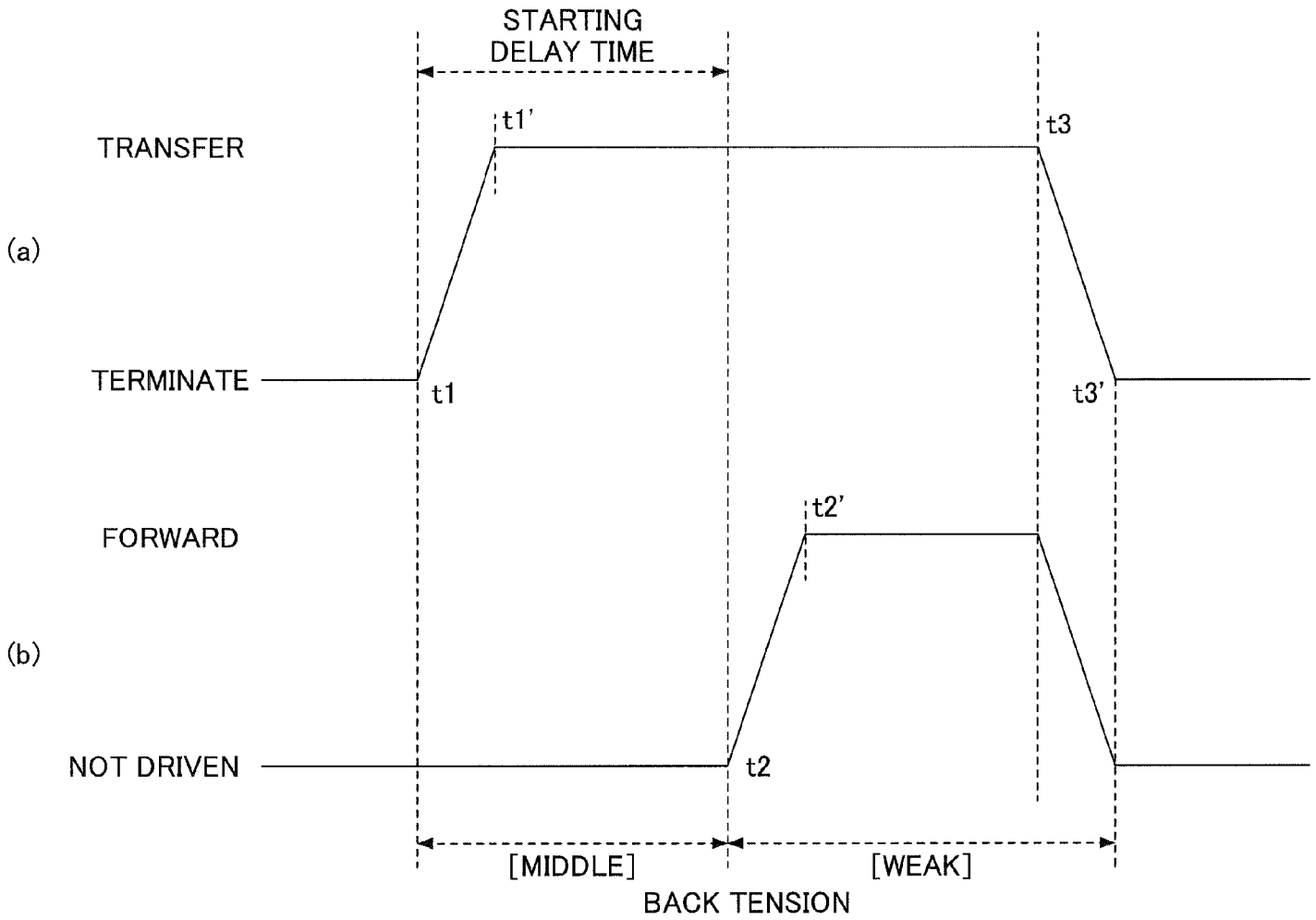
FIG. 14 is a view showing another example of a timing of controlling the drive motor DM by the control unit of the medium supplying apparatus of the embodiment.

FIG. 14 is a view showing another timing of controlling the drive motor DM by the control unit 100 of the medium supplying apparatus 90 of the embodiment. In FIG. 14, (a) shows a driving timing of the resist roller 34 of the transfer unit 36 for the rolled paper 30, and (b) shows a control timing of the drive motor DM by the control unit 100. For the example shown in FIG. 14, the rolled paper 30 is started to be transferred by the resist roller 34 at time t1. At this time, the drive motor DM is controlled to not be power supplied (not driven). Then, the control unit 100 controls the drive motor DM to be rotated in the forward direction at time t2 when a previously set predetermined period has passed after time t1. Then, the control unit 100 controls the drive motor DM to not be power supplied (not driven) at time t3 when the transferring of the rolled paper 30 is terminated.

Thus, by changing the states of the drive motor DM from not being power supplied (not driven) to being rotated in the forward direction while the rolled paper 30 is being transferred, the back tension applied to the rolled paper 30 can be changed from "middle" to "weak". Therefore, by appropriately determining the starting delay time, the back tension applied to the rolled paper 30 which is being transferred can be set to a desired strength between "weak" to "middle".

Alternatively, for the example shown in FIG. 14, as well, by providing the terminating delay time to rotate the drive motor DM in the reverse direction after the transferring of the rolled paper 30 is terminated, it is possible to prevent the looseness from being generated in the rolled paper 30. Alternatively, the strength of the back tension may not be changed during the transferring of the rolled paper 30, and the drive motor DM may be rotated in the reverse direction for a predetermined period after the transferring of the rolled paper 30 is terminated to remove the looseness.

It is necessary to appropriately determine the strength of the back tension applied to the rolled paper 30 in accordance with the kind of, the width of and the remaining amount of the rolled paper 30.

For example, when the thickness or the width of the rolled paper 30 is larger, or when the remaining amount is larger even when the width of the rolled paper 30 is not so large, an influence of the inertia caused when the rolled paper 30 is being transferred becomes greater so that the inclination or the looseness is easy to be generated. Therefore, it is necessary to apply a strong back tension.

On the other hand, when the thickness or the width of the rolled paper 30 is smaller, or the remaining amount is smaller even when the width of the rolled paper 30 is large, the influence of the inertia applied to the rolled paper 30 becomes less so that the inclination of the looseness can be suppressed even when the back tension is weak.

The memory 101 of the control unit 100 stores the control table in which the starting delay time and the terminating delay time with respect to the width and the remaining amount of the rolled paper 30 are set for applying an appropriate back tension to the rolled paper 30 to remove the looseness.

In this embodiment, the control unit 100 determines whether to set the strength of the back tension applied to the rolled paper 30 between "weak" and "middle" or between "middle" to "strong" based on the kind of the rolled paper 30.

FIG. 15 is a view showing an example of the control table including the starting delay time for the back tension "middle to weak".

As shown in FIG. 14, when controlling the back tension to "middle to weak", the drive motor DM is controlled to not be power supplied (not driven) to be rotated in the forward direction when the starting delay time has passed after the transferring of the rolled paper 30 is started.

By setting the starting delay time shorter, the back tension becomes close to "weak", and by setting the starting delay time longer, the back tension becomes close to "middle".

Thus, the starting delay time is set to be shorter as the width of the rolled paper 30 or the remaining amount of the rolled paper 30 becomes smaller. On the other hand, the starting delay time is set to be longer as the width of the rolled paper 30 or the remaining amount of the rolled paper 30 becomes larger. For the case shown in FIG. 15, the starting delay time is set between $T_{a1}$ to $T_{a5}$ ($T_{a1}<T_{a2<Ta3}<T_{a4}<T_{a5}$) in accordance with the width and the remaining amount of the rolled paper 30.

For the example when the back tension is "middle to weak" shown in FIG. 14, the terminating delay time is not provided, which is different from the example shown in FIG. 13. However, in this example as well, if the looseness of the rolled paper 30 is caused by the inertia when transferring the rolled paper 30, the terminating delay time for rotating the drive motor DM in the reverse direction after the transferring of the rolled paper 30 is terminated may be provided.

FIG. 16 is a view showing an example of the control table including the starting delay time and the terminating delay time for the back tension "middle to strong".

As shown in FIG. 13, when controlling the back tension to "middle to strong", the drive motor DM is controlled to not be power supplied (not driven) to be rotated in the reverse direction when the starting delay time has passed after the transferring of the rolled paper 30 is started.

Thus, by setting the starting delay time shorter, the back tension becomes close to "strong", and by setting the starting delay time longer, the back tension becomes closet to "middle".

Thus, the smaller the width the width of the rolled paper 30 and the smaller the remaining amount of the rolled paper 30 is, the starting delay time is set to be longer. On the other hand, the larger the width of the rolled paper 30 is and the larger the remaining amount of the rolled paper 30 is, the starting delay time is set to be shorter. For the case shown in FIG. 16, the starting delay time is set between $T_{a11}$ and $T_{a55}$ ($T_{a11}<T_{a22}<T_{a33}<T_{a44}<T_{a55}$) in accordance with the width and the remaining amount of the rolled paper 30.

Further, the larger the width of the rolled paper 30 is and the larger the remaining amount of the rolled paper 30 is, the more easily looseness of the rolled paper 30 is generated by the influence of inertia. Thus, the terminating delay time for removing the looseness is set between $T_{b11}$ to $T_{b55}$ ($T_{b11<Tb22}<T_{b33}<T_{b44}<T_{b55}$) in accordance with the width and the remaining amount of the rolled paper 30.

The control tables shown in FIG. 15 and FIG. 16 which are stored in the memory 101 of the control unit 100, may include the starting delay time and the terminating delay time correspond to a transferring amount of the rolled paper 30 transferred by a single rotation of the resist roller 34, for example.

Correction of the starting delay time and the terminating is explained.

When the back tension is applied to the rolled paper 30, the starting delay time and the terminating delay time may be controlled by increasing and decreasing the set starting delay time and the terminating delay time in accordance with the actual transferring amount of the rolled paper 30. The actual transferring amount of the rolled paper 30 means an intermitted transferring amount previously set in accordance with a kind of paper and/or a printing mode. The intermitted transferring amount may be previously stored in a predetermined storage such as the memory 101 in a form of a ratio with respect to the transferring amount of the rolled paper 30 transferred by a single rotation of the resist roller 34, for example. Thus, the starting delay time and the terminating delay time may be corrected based on the kind of paper and/or the printing mode and the previously stored intermitted transferring amount.

Figure 17:
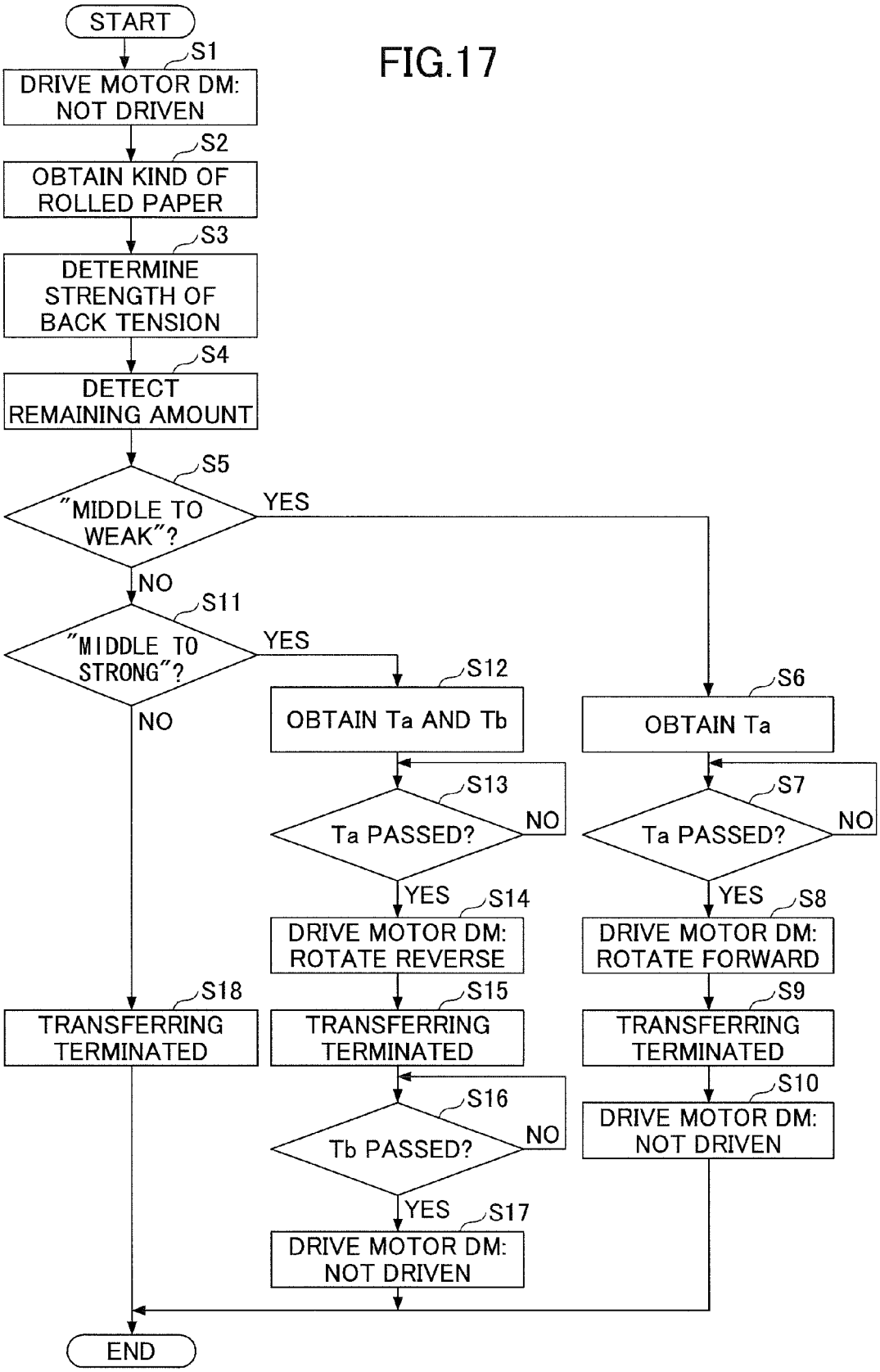
FIG. 17 is a flowchart showing an operation by the medium supplying apparatus of the embodiment after the rolled paper is started to be transferred.
Figure 18:
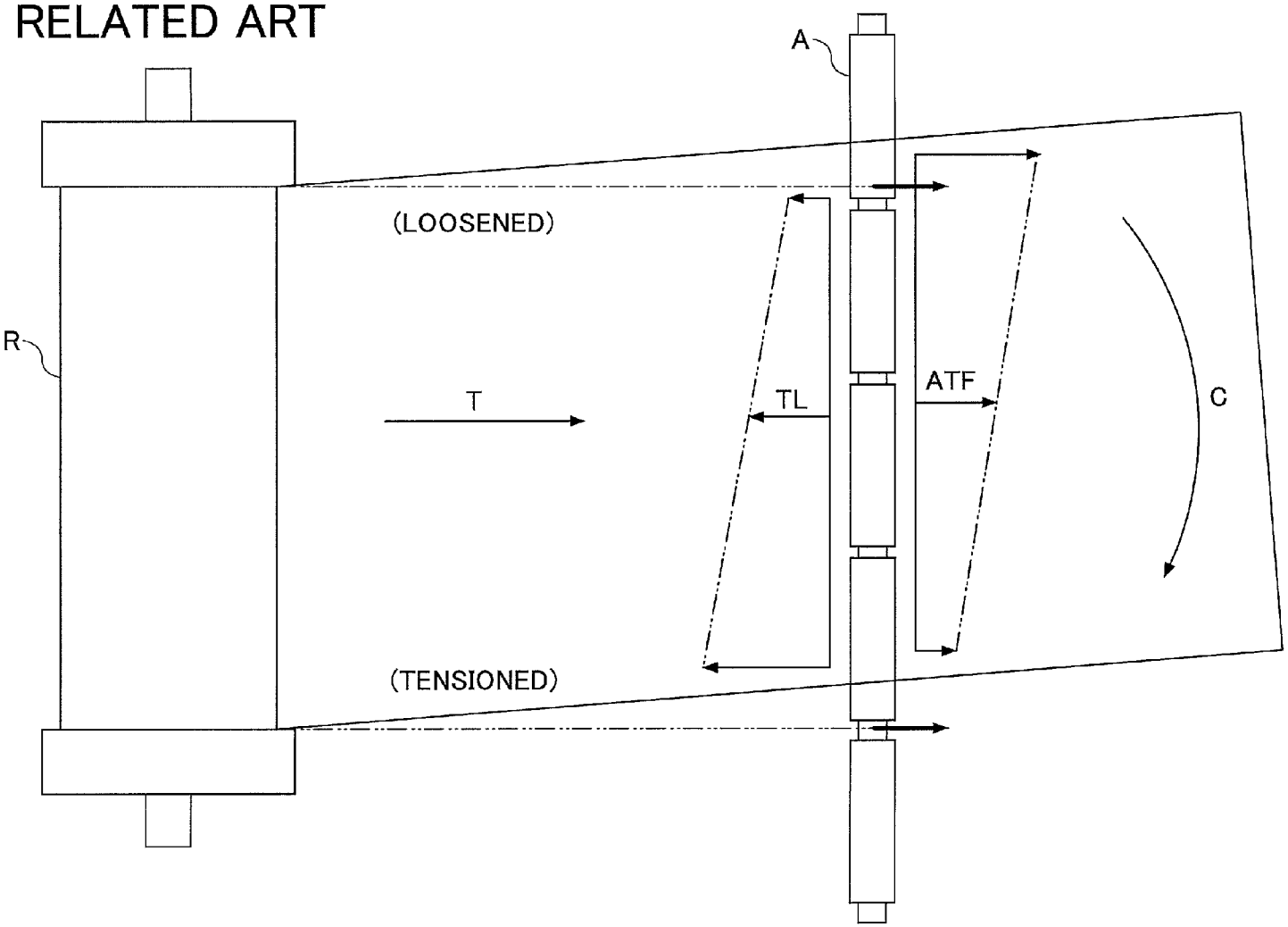
FIG.18 RELATED ART
FIG. 18 is a view for explaining a correction of an inclination of a rolled paper by applying a back tension.

FIG. 17 is a flowchart showing an operation by the medium supplying apparatus 90 of the embodiment after the rolled paper 30 is started to be transferred.

When the rolled paper 30 is started to be transferred, the control unit 100 controls the drive motor DM to not be power supplied (not driven) in step S1. Then in step S2, information about the kind of the rolled paper 30 is obtained. Subsequently, in step S3, the control unit 100 determines the back tension to be applied to the rolled paper 30 from "middle to weak", "middle", "middle to strong" based on the kind of the rolled paper 30. Then, in step S4, the remaining paper sensor S2 detects the remaining amount of the rolled paper 30.

When the strength of the back tension determined in step S3 is "middle to weak" (YES in step S5), the control unit 100 obtains the starting delay time $T_a$ corresponding to the width and the remaining amount of the rolled paper 30 detected in step S4 from the control table stored in the memory 101 shown in FIG. 15. Here, the obtained starting delay time $T_a$ may be corrected in accordance with the transferring amount of the rolled paper 30, if necessary.

Then, when the starting delay time Ta has passed after the transferring of the rolled paper 30 is started (YES in step S7), the drive motor DM is rotated in the forward direction by a predetermined number of rotations to change the back tension applied to the rolled paper 30 from "middle" to "weak" (step S8).

When the transferring of the rolled paper 30 is terminated in step S9, the control unit 100 controls the drive motor DM to not be power supplied (not driven) in step S10. Then, the operation is terminated.

When the strength of the back tension determined in step S3 is "middle to strong" (YES in step S11), the control unit 100 obtains the starting delay time $T_a$ and the terminating delay time $T_b$ corresponding to the width and the remaining amount of the rolled paper 30 detected in step S4 from the control table stored in the memory 101 shown in FIG. 16 (step S12). Here, the obtained starting delay time $T_a$ and the terminating delay time $T_b$ may be corrected in accordance with the transferring amount of the rolled paper 30, if necessary.

Then, when the starting delay time $T_a$ has passed after the transferring of the rolled paper 30 is started (YES in step S13), the control unit 100 controls the drive motor DM to be rotated in the reverse direction (step S14).

Subsequently, when the transferring of the rolled paper 30 is terminated in step S15, and the terminating delay time $T_b$ has passed after the termination (YES in step S16), the control unit 100 controls the drive motor DM to not be power supplied (not driven) to terminate the operation.

When the strength of the back tension determined in step S3 is "middle" (NO in step S5 and NO in S11), the control unit 100 maintains the state where the drive motor DM is not being power supplied (not driven). Then, the transferring of the rolled paper 30 is terminated in step S18 to terminate the operation.

By the above operation, an appropriate back tension based on the kind of, the width of and the remaining amount of the rolled paper 30 can be applied, and the generation of the looseness can be suppressed after the transferring of the rolled paper 30 is terminated.

According to the embodiment, a medium supplying apparatus and an image forming apparatus including the medium supplying apparatus capable of variably controlling the strength of the back tension in accordance with the size or the remaining amount of the rolled paper to suppress the generation of the looseness of the rolled paper with a simple structure can be provided.

Although a preferred embodiment of the medium supplying apparatus and the image forming apparatus have been specifically illustrated and described, it is to be understood that minor modifications may be made therein without departing from the sprit and scope of the invention as defined by the claims.

The present invention is not limited to the specifically disclosed embodiments, and variations and modifications may be made without departing from the scope of the present invention.

The present application is based on Japanese Priority Application No. 2011-251951 filed on Nov. 17, 2011, the entire contents of which are hereby incorporated by reference.

What is claimed is:

1. A medium supplying apparatus for applying a back tension opposite to a transferring direction of a rolled medium being transferred by a transfer unit, to the rolled medium, comprising:

a driving unit including a drive gear configured to be rotated in a forward direction and a reverse direction while the rolled medium is being transferred in the transferring direction by the transfer unit;

a rotation transmitting mechanism that includes a one-way clutch and a torque limiter and transmits a rotational force between the driving unit and a medium rotation shaft of the rolled medium via the one-way clutch and the torque limiter, the rotation transmitting mechanism being configured such that a load applied to the medium rotation shaft is reduced by rotating the drive gear in the forward direction so that the back tension becomes weaker while the rolled medium is being transferred in the transferring direction by the transfer unit, and the load applied to the medium rotation shaft by the transfer unit is increased by rotating the drive gear in the reverse direction so that the back tension becomes stronger while the rolled medium is being transferred in the transferring direction by the transfer unit; and a control unit that controls a power supply to the driving unit so that the driving unit becomes either power supplied to rotate the drive gear in the forward direction, not power supplied, or power supplied to rotate the drive gear in the reverse direction, while the rolled medium is being transferred in the transferring direction by the transfer unit, to apply the back tension of different strength degrees.

2. The medium supplying apparatus according to claim 1, wherein the control unit controls the power supply to the driving unit to be rotated in the reverse direction after the transferring of the rolled medium by the transfer unit in the transferring direction is terminated so as to rotate the medium rotation shaft to rewind the rolled medium.

3. The medium supplying apparatus according to claim 2, wherein the control unit receives a kind of the rolled medium, a width of the rolled medium or a remaining amount of the rolled medium, and wherein a period for which the control unit controls the power supply to the driving unit to be rotated in the reverse direction so as to rotate the medium rotation shaft to rewind the rolled medium is determined based on the kind of the rolled medium, the width of the rolled medium or the remaining amount of the rolled medium.

4. The medium supplying apparatus according to claim 3, wherein the predetermined period determined based on the kind of the rolled medium, the width of the rolled medium or the remaining amount of the rolled medium is further corrected based on a transferring amount of the rolled medium in the transferring direction by the transfer unit.

5. The medium supplying apparatus according to claim 1, wherein the control unit receives a kind of the rolled medium, a width of the rolled medium or a remaining amount of the rolled medium and controls the power supply to the driving unit so that the driving unit becomes, in the following order:

not power supplied when the rolled medium is not being transferred by the transfer unit, and power supplied to rotate the drive gear in the forward direction or in the reverse direction when a predetermined period has passed after the rolled medium is started to be transferred by the transfer unit in the transferring direction, the predetermined period being determined based on the kind of the rolled medium, the width of the rolled medium or the remaining amount of the rolled medium.

6. The medium supplying apparatus according to claim 5, wherein the predetermined period determined based on the kind of the rolled medium, the width of the rolled medium or the remaining amount of the rolled medium is further corrected based on a transferring amount of the rolled medium in the transferring direction by the transfer unit.

7. The medium supplying apparatus according to claim 1, wherein the rotation transmitting mechanism includes a middle rotation shaft to which the torque limiter is provided and which is coaxial with the one-way clutch, the one-way clutch is configured to lock the rotation of the middle rotation shaft in a rotating direction when the middle rotation shaft is rotated, and the rotation transmitting mechanism is configured to, when the rolled medium is being transferred by the transfer unit in the transferring direction and the driving unit is not being power supplied, transmit the rotational force from the medium rotation shaft to the drive gear of the driving unit to apply the middle tension to the rolled medium, when the rolled medium is being transferred by the transfer unit in the transferring direction and the driving unit is being power supplied so that the drive gear is rotated in the forward direction, rotate the middle rotation shaft by the driving unit so that the rotational force from the medium rotation shaft is only transmitted to the one-way clutch to apply the weak tension to the rolled medium, and when the rolled medium is being transferred by the transfer unit in the transferring direction and the driving unit is being power supplied so that the drive gear is rotated in the reverse direction, shut off a transmit force between the medium rotation shaft and the driving unit by the torque limiter so that the middle rotation shaft is rotated while slipping in the torque limiter to apply the strong tension to the rolled medium.

8. The medium supplying apparatus according to claim 7, wherein the rotation transmitting mechanism is configured to transmit the rotational force from the driving unit to the medium rotation shaft when the rolled medium is not being transferred by the transfer unit and the driving unit is rotated in the reverse direction to rotate the medium rotation shaft in a direction opposite to the transferring direction.

9. An image forming apparatus, comprising:

the medium supplying apparatus according to claim 1; and the transfer unit that transfers the rolled medium.

10. The medium supplying apparatus according to claim 1, wherein the drive unit is configured so that a drag torque of the driving unit is set to be less than or equal to a limitation of the torque limiter so that the drive gear is rotatable due to a load applied to the medium rotation shaft while the rolled medium is being transferred in the transferring direction by the transfer unit even when the driving unit is not being power supplied.

11. The medium supplying apparatus according to claim 1, wherein the driving unit is controlled independently from the transfer unit.

* * * * *